United States Patent [19]

Kondo et al.

[11] Patent Number: 4,865,476

[45] Date of Patent: Sep. 12, 1989

[54] CARRIAGE MECHANISM PROVIDING MOVEMENT OF A PRINT WHEEL MOTOR

[75] Inventors: Hiroatsu Kondo, Zushi; Toshiaki Ozawa, Urayasu; Hiroharu Nakajima, Kodaira; Hiroyuki Ueda, Kawasaki, all of Japan

[73] Assignee: Canon Kabushiki Kaisha, Tokyo, Japan

[21] Appl. No.: 158,130

[22] Filed: Feb. 16, 1988

Related U.S. Application Data

[63] Continuation of Ser. No. 940,187, Dec. 9, 1986, abandoned, which is a continuation of Ser. No. 777,556, Sep. 17, 1985, abandoned, which is a continuation of Ser. No. 529,615, Sep. 6, 1983, abandoned, which is a continuation of Ser. No. 354,904, Mar. 4, 1982, abandoned.

[30] Foreign Application Priority Data

| | | | |
|---|---|---|---|
| Mar. 13, 1981 | [JP] | Japan | 56-35309 |
| Mar. 13, 1981 | [JP] | Japan | 56-35310 |
| Mar. 13, 1981 | [JP] | Japan | 56-35311 |

[51] Int. Cl.[4] ..... B41J 1/30

[52] U.S. Cl. ..... 400/144.2; 400/175; 400/352; 400/356

[58] Field of Search ..... 400/55, 56, 57, 58, 400/59, 60, 144.2, 144.3, 175, 352, 353, 355, 356, 358

[56] References Cited

U.S. PATENT DOCUMENTS

| | | | |
|---|---|---|---|
| 3,349,702 | 10/1967 | Nesin et al. | 101/DIG. 13 |
| 4,049,109 | 9/1977 | Plaza et al. | 400/144.2 X |
| 4,197,022 | 4/1980 | Dollenmayer | 400/144.2 |
| 4,310,255 | 1/1982 | Asano et al. | 400/175 X |
| 4,469,454 | 9/1984 | Crean | 400/175 X |

FOREIGN PATENT DOCUMENTS

| | | | |
|---|---|---|---|
| 2838627 | 3/1979 | Fed. Rep. of Germany | 400/55 |
| 2824621 | 12/1979 | Fed. Rep. of Germany | 400/59 |
| 142316 | 6/1980 | German Democratic Rep. | 400/144.2 |
| 148034 | 5/1981 | German Democratic Rep. | 400/144.2 |
| 64229 | 5/1977 | Japan | 400/59 |

OTHER PUBLICATIONS

Okcuoglu, et al., "Automatic Printwheel Removal Mechanism", *IBM Technical Disclosure Bulletin,* vol. 22, No. 4, Sep. 1979, pp. 1538–1539.

*Primary Examiner*—David A. Wiecking
*Attorney, Agent, or Firm*—Cella, Harper & Scinto Fitzpatrick

[57] ABSTRACT

Disclosed is a printing mechanism having a printing head mounted on a carriage frame so as to linearly move the printing head toward a platen.

10 Claims, 4 Drawing Sheets

CARRIAGE MECHANISM PROVIDING MOVEMENT OF A PRINT WHEEL MOTOR

This application is a continuation of application Ser. No. 940,187 filed 12/9/86, which is a continuation of Ser. No. 777,556, filed Sept. 17, 1985, which is a continuation of Ser. No. 529,615, filed Sept. 6, 1983, which is a continuation of Ser. No. 354,904, filed Mar. 4, 1982 all now abandoned.

BACKGROUND OF THE INVENTION

1. Field of the Invention

The present invention relates to a printing mechanism and, more particularly, to a printing mechanism for printing letters using a printing head which includes printing type elements.

2. Description of the Prior Art

An impact-type printing mechanism is conventionally known. In this printing mechanism, a daisy-type printing type wheel having a number of radially disposed spokes, with the top of each spoke having a printing type, is rotated at high speed. When a selected printing type reaches a predetermined printing position, a printing hammer is activated synchronously therewith. The printing type is struck on a printing paper sheet, such as a recording medium, placed on a platen and thus printing is performed.

The printing mechanism of this type can perform high speed printing and produces clearly printed letters. However, the printing type wheel must be frequently replaced due to the short service life thereof. Further, a number of printing type wheels must be interchanged in accordance with the various type faces, resulting in inconvenience. Therefore, easy interchange of the printing type wheels is greatly desired.

FIGS. 1 and 2 show an example of a conventional printing mechanism of this type. A printing type wheel 2 has a number of radially disposed spokes, with the top of each spoke having a printing type portion 2*b*The spokes are adapted to oppose a platen 1. The printing type wheel 2 is fitted on an output shaft 3*a* of an electric motor 3 through a boss 2*a*. A pin is disposed at the side surface of the motor 3. A spring 6 is hooked across the pin 4 and a pin 5 which is disposed at the stationary section of the printer. The motor 3 is pivotal about a shaft 7.

Referring to FIG. 1, the pin 4 is located to the left of the shaft 7 and on the side of the platen 1. The tension is applied on the spring 6 so as to pivot the motor 3 in the counterclockwise direction in the figure. The motor 3 is in contact with a stopper 8 in FIG. 1. Thus, the printing mode is initiated and printing with a hammer 9 is performed. However, in order to interchange the currently mounted printing type wheel 2 with another, the motor 3 must be pivoted about the shaft 7 in the clockwise direction as shown in FIG. 2. In this position, the pin 4 is located above the shaft 7 and a line connecting the pins 4 and 5 is located outside the shaft 7 with respect to the platen 1. Thus a pivotal force in the clockwise direction is applied to the motor 3. As shown in FIG. 2, the printing type wheel is widely separated from the platen 1 and the printing type wheel 2 faces substantially upward.

The structure of the printing mechanism described above is very simple and convenient. However, when the printing type wheel 2 is pivoted, a large space for the pivotal movement is required and a dead space is formed in the printer. When a structure is adopted wherein an ink ribbon is led between the platen 1 and the printing type wheel 2, the arrangement of the component parts is restricted. Further, when the stopper 8 is slightly misaligned, the relative positions of the platen 1 and the printing type wheel 2 and an angle formed therebetween tend to change greatly. In the printing mode, the spring 6 must provide a considerably strong tension, resulting in inconvenience in the operation by the operator.

As shown in FIG. 3, a structure has been proposed in order to decrease the space needed for the pivotal movement. Referring to FIG. 3, since the fulcrum is located above the pin 5 of FIG. 2 and behind the motor 3, the printing type wheel 2 can be pivoted outside the printer and the saved space may be used for other purposes.

However, when this structure is adopted, the boss 2*a*, the printing type portion 2*b* of the spoke and the like may come in contact with a contamination preventing plate (not shown) disposed between the platen 1 and the printing type wheel 2 and other component parts when the printing type wheel 2 is to be interchanged.

Further, in the conventional printing mechanisms of this type, the distance between the printing type wheel and the platen is restricted to 2 to 3 mm so as to improve the durability of the printing type wheel. Therefore, when a thick printing paper sheet is used or when a plurality of copies are required, the printing operation becomes cumbersome.

SUMMARY OF THE INVENTION

It is an object of the present invention to provide a printing mechanism for interchanging, easily and safely, a printing element.

It is another object of the present invention to provide a printing mechanism wherein dead space is decreased.

It is still another object of the present invention to provide a printing mechanism wherein a printing head is firmly fixed at a printing ready position.

It is still another object of the present invention to provide a printing mechanism wherein a distance between the printing head and a platen can be adjusted easily.

It is still another object of the present invention to provide a printing mechanism of a simple construction.

It is still another object of the present invention to provide a printing mechanism wherein the printing head can be separated widely from the platen by means of a lever.

The above and other objects, features and advantages of the present invention will be apparent from the following description when taken in conjunction with the accompanying drawings.

DETAILED DESCRIPTION OF THE PREFERRED EMBODIMENTS

Figure 1:
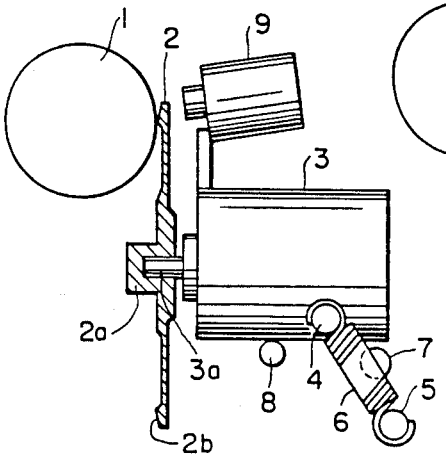
FIG. 1 PRIOR ART
FIGS. 1 and 2 are side views for explaining the printing mode and the mode for interchanging one printing type wheel for another, respectively, in a conventional printing mechanism.
Figure 2:
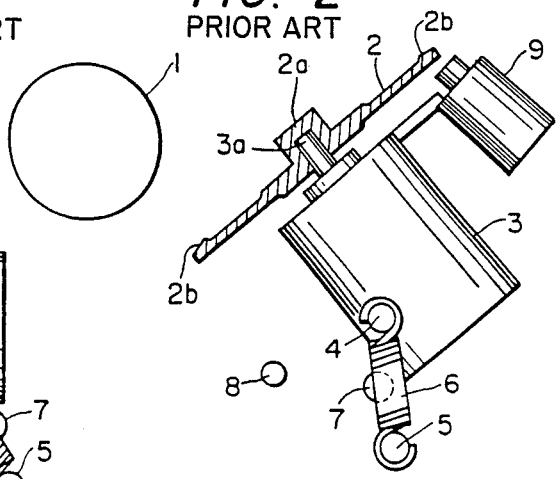
FIG. 2 PRIOR ART
Figure 3:
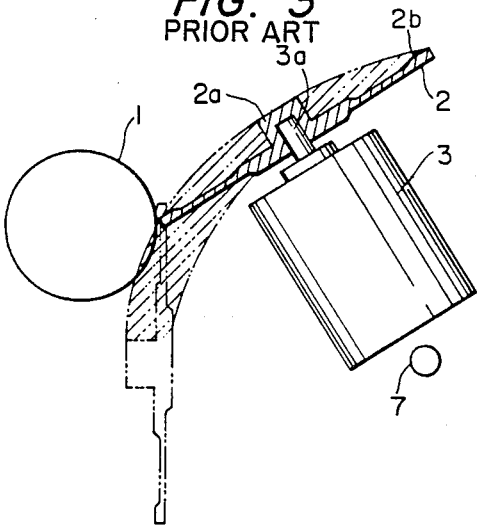
FIG. 3 PRIOR ART
FIG. 3 is a side view of another conventional printing mechanism.
Figure 4:
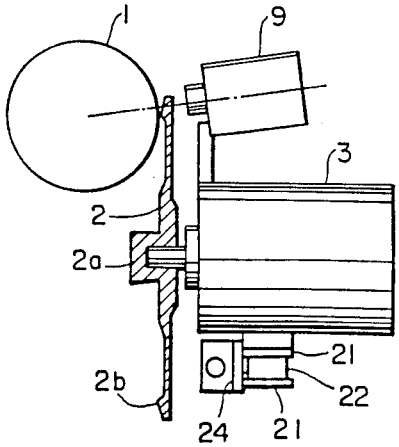
FIGS. 4 and 5 are side views of a printing mechanism for explaining the mode of operation according to the present invention.
Figure 5:
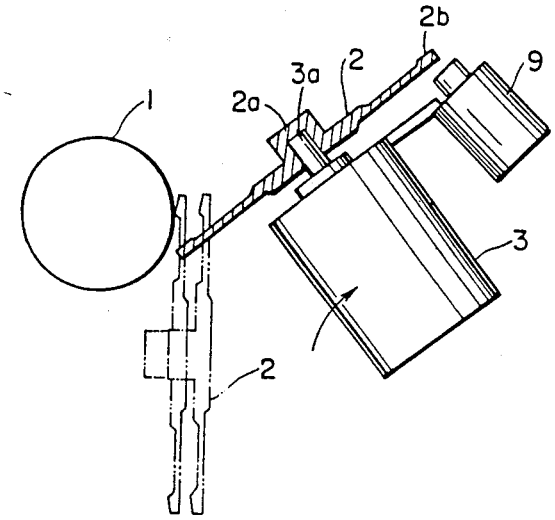

Referring to FIGS. 4 and 5, a printing mechanism according to a first embodiment of the present invention will be described. The same reference numerals in FIGS. 1 to 3 denote the same parts as in FIGS. 4 and 5.

As is apparent from FIG. 5, the printing type wheel 2 which is the printing type element which constitutes the printing head, a motor 3 for driving the printing type wheel 2, and a hammer 9 for striking the matrix type portion 2*b* of the printing type wheel 2, are moved in parallel away from the platen 1. Thereafter, the printing head is pivoted so as to orient the printing head upward.

Figure 6:
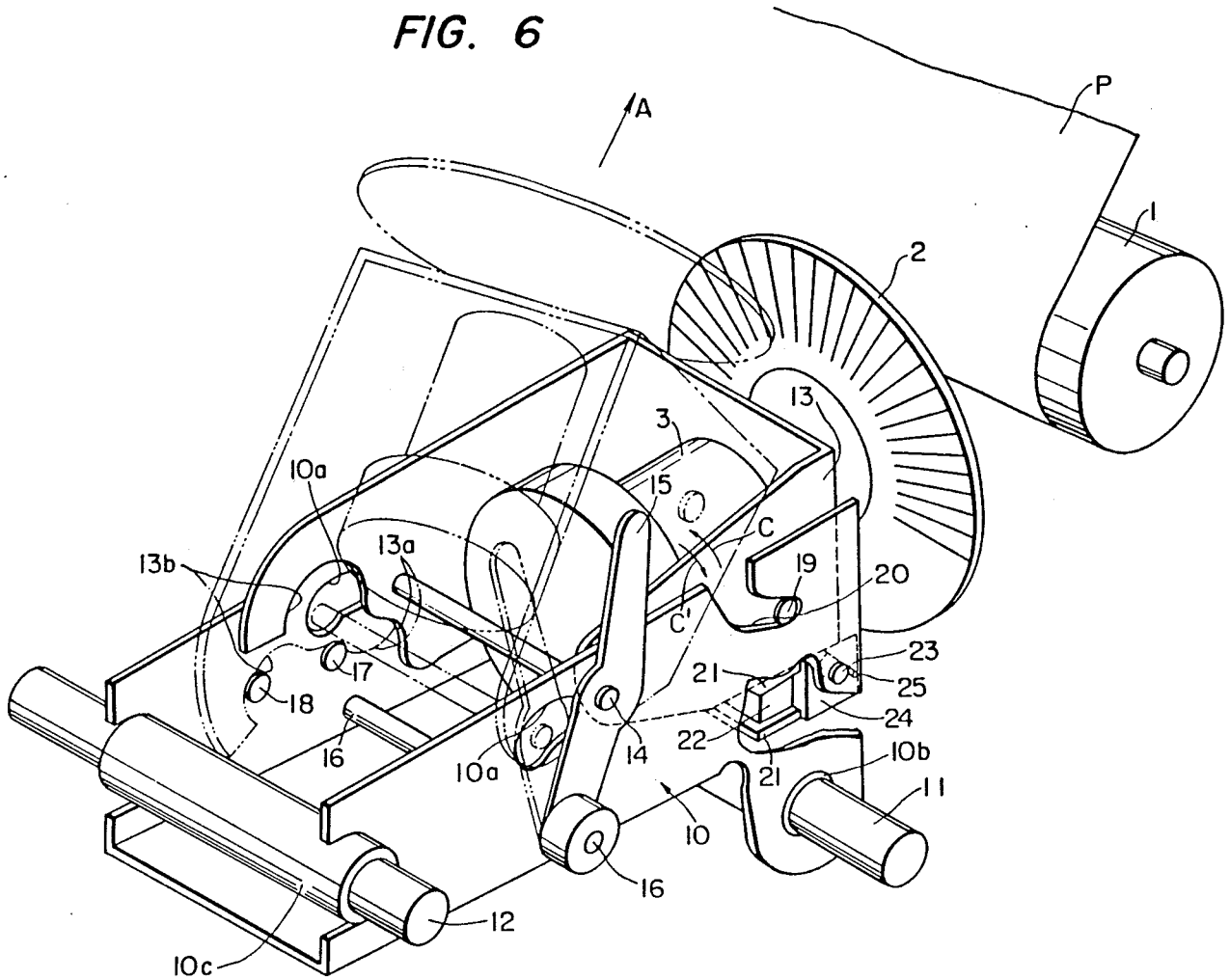
FIG. 6 is a perspective view of a printing mechanism according to a first embodiment of the present invention.

FIG. 6 is a perspective view of the printing mechanism of the first embodiment. Referring to FIG. 6, a carriage frame 10 serves as the carriage means of the printing head. The carriage frame 10 is slidably fitted around two guide shafts 11 and 12 and is moved parallel to the platen 1. A bearing 10*b* is mounted on the guide shaft 11 and a bearing 10*c* is mounted on the guide shaft 12. A retaining case 13, which retains the printing head, is housed inside the carriage frame 10. The retaining case 13 comprises a frame of a substantially U shape. The motor 3 is integrally mounted on the frame of the retaining case 13 and the printing type wheel 2 is fitted on an output shaft 3*a* of the motor 3.

A shaft 14 is disposed across the sides of the rear end portion of the retaining case 13. Both ends of the shaft 14 are slidably fitted into arcuated grooves 10*a* formed at opposite positions in both side plates of the carriage frame 10. The central portion of a control lever 15 located outside the carriage frame 10 is fitted on one end of the shaft 14 so as to make the control lever 15 pivotable. The lower end of the control lever 15 is pivotally mounted on one side plate of the carriage frame 10 through a shaft 16. Therefore, the control lever 15 may be called a link mechanism which couples the carriage frame 10 and the retaining case 13. Two arcuated cams 13*a* and 13*b* are formed at the rear end of one of the side plates of the retaining case 13. The arcuated cams 13*a* and 13*b* are adapted to fit with pins 17 and 18, respectively, which extend from the inner surface of the carriage frame 10. The pin 17 is fitted with the cam 13*a* so as to rotate the retaining case 13 in two directions indicated by arrows C and C'. The pin 18 is fitted with the cam 13*b* so as to define the range of rotation of the retaining case 13 in the direction indicated by arrow C.

Projections 19 are formed at the sides in the vicinity of the front end of the retaining case 13. The projections 19 are adapted to be slidably fitted in L-shaped notches 20 formed in the sides in the vicinity of the front end of the carriage frame 10. The tops of the notches 20 linearly extend toward the platen 1. When the retaining case 13 is to be moved from the position indicated by the alternate long and two dashed lines of FIG. 6 to the position indicated by the solid line, the retaining case 13 is first rotated in the direction indicated by arrow C' and is then substantially linearly moved toward the platen 1. Therefore, the printing type wheel 2 stops opposing the front surface of the platen 1. In the above embodiment, projections are formed on the side of the retaining case 13 and the notches are formed on the side of the carriage frame 10. However, the notches may be formed on the side of the retaining case 13 and the projections may be formed on the side of the carriage frame 10. Further, these projections and notches are not always necessary. For example, the bottom surface of the retaining case may be slid on the bottom surface of the carriage case. Thus, head retaining means is constituted by the retaining case 13 which is integral with the printing head, and the control lever 15 as the link member which pivotally couples the retaining case 13 to the carriage frame 10. Further, the printing head is linearly withdrawn from the platen 1 by the projections 19 of the retaining case 13 and the notches 20 of the carriage frame 10. The printing head is pivoted outside the printer.

A magnet 22 is clamped by two yokes 21 on the side of the motor 3. In the printing mode, an armature 24 of a magnetic body which serves as means for fixing the printing head at a predetermined position is pivotally supported at a position at which the armature 24 comes in contact with the yokes 21 through a shaft 23. The armature 24 is pivotal about the shaft 23. However, the pivotal movement of the armature 24 is restricted by a pin 25 mounted on the carriage frame 10 and only a small space for the pivotal movement is given. The retaining case 13 and the printing head stop moving toward the platen 1 when the magnet 22 abuts against the armature 24.

The mode of operation of the printing mechanism with the above arrangement will be described hereinafter. In the normal printing mode, as indicated by the solid lines of FIGS. 4 and 6, the motor 3 and the retaining case 13 formed integrally therewith are maintained substantially horizontal. The line of magnetic force generated by the magnet 22 is applied to the armature 24 through the yokes so as to attract the armature 24. Thus, the printing head is firmly fixed to the carriage frame 10 and the printing state is maintained. Printing is performed in this condition. When the printing type wheel 2 is to be replaced, the control level 15 is pivoted about the shaft 16 by hand in the counterclockwise direction indicated by the alternate long and two dashed lines of FIG. 6. The shaft 14 thus moves to the rear ends of the elongate arcuated holes 10*a* therealong. Simultaneously, the projections 19 are moved backward along the L-shaped notches 20. As a result, the retaining case 13 and the printing type wheel of the printing head are moved parallel to separate from the platen 1. When the control lever 15 is further pivoted in the counterclockwise direction of FIG. 6, the arcuated cam 13*a* at the rear end of the retaining case 13 comes in contact with the pin 17 as indicated by the alternate long and two dashed line of FIG. 6. As a result, the retaining case 13 is pivoted about the pin 17 at the fulcrum so as to face the printing type wheel 2 upward. The arcuated cam 13*b* is then engaged with the pin 18. The retaining case 13 which is guided by the pin 18 stops rotating so as to maintain the printing type wheel 2 at a maximum upward position. In this position, the projections 19 are not engaged with the notches 20. In the initial period of operation, the yokes 21 are forcibly separated from the armature 24.

Since the parallel movement of the printing type wheel 2 is performed in the initial period of operation, the positions of the printing type wheel 2 and the plane 1 are not misaligned even if the armature 24 fixed in the carriage frame 10 is slightly mislocated. The printing operation is thus properly performed. Further, when the printing type wheel 2 is to be interchanged, it can be freely pivoted and is not brought into unnecessary contact with other component parts. The movement of the printing type wheel 2 thus does not interfere with the operation of other component parts.

After the printing type wheel 2 is interchanged, the reverse operation to that described above is performed. The retaining case 13 is pivoted in the clockwise direction of FIG. 6. The projections 19 are fitted into the arcuated notches 20. Further, the yokes 21 attract the armature 24 which is thus located at a predetermined position.

Figure 7:
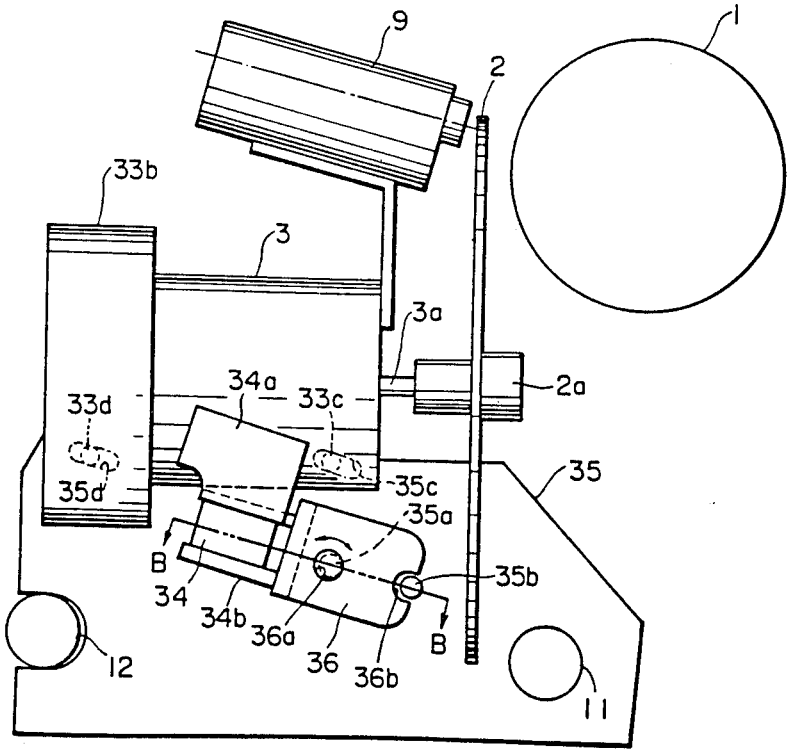
FIGS. 7 and 8 are side views of a printing mechanism according to a second embodiment of the present invention.
Figure 8:
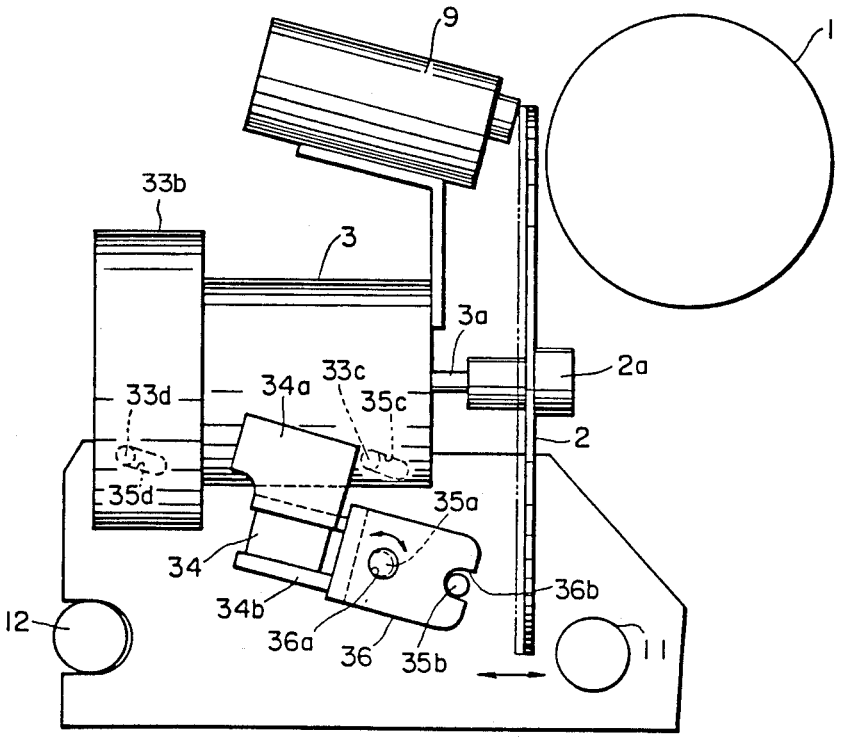

A printing mechanism of a second embodiment of the present invention will be described with reference to FIGS. 7 and 8. The platen 1 is disposed in association with the printing type wheel 2 in the manner as described in the first embodiment. The printing type wheel 2 has a number of radially disposed spokes, with the top of each spoke having printing type portion **2*b*. The printing type wheel 2 is fitted on the top of the output shaft 3*a* of the motor 3. An encoder 33*b* which detects the position of the printing type wheel 2 is disposed at the rear end of the motor 3**.

Projections **33*c* are formed on both sides of the motor 3. Projections 33*d* are formed on both ends of the encoder 33*b*. The projections 33*c* are fitted in elongate holes 35*c* formed in right and left carriage frames 35. The projections 33*d* are slidably fitted in the elongate holes 35*d* formed in the both carriage frames 35. Printing head retaining means is thus constituted by the projections 33*c* and 33*d* and the elongate holes 35*c* and 35*d* so as to linearly, slidably hold the printing head toward the platen 1**.

A yoke **34*a* is formed at the side of the motor 3. A magnet 34 is fixed to the lower end of the yoke 34*a*. Further, a yoke 34*b* is fixed to the lower surface of the magnet 34 so as to clamp the magnet with the yoke 34*a***.

Figure 9:
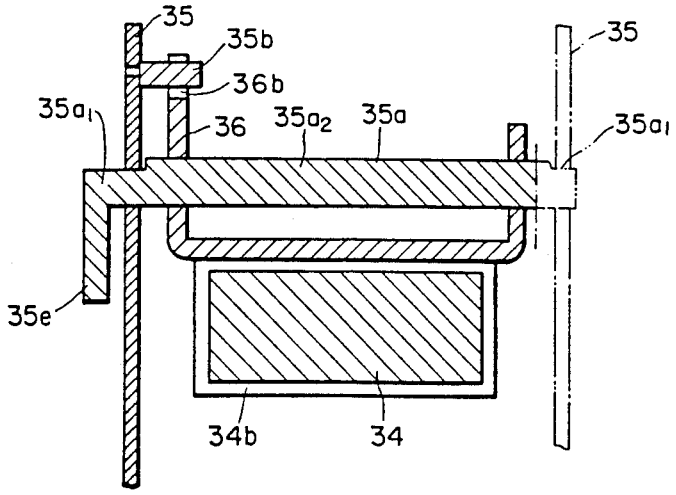
FIG. 9 is a sectional view along the line B—B of FIG. 7.

A small diameter portion **35*a*1 of an eccentric shaft 35*a* is supported between the right and left carriage frames 35. The shaft 35*a* which is an eccentric shaft can be pivoted by a lever 35*e* extending outside the carriage frame 35 as shown in FIG. 9. An armature 36 of magnetic body and substantially U-shape is fitted in the hole 36*a* of a large diameter portion 35*a*2 of the eccentric shaft 35*a*. Since the diameter of the hole 36*a* is slightly larger than that of the large diameter portion of the eccentric shaft 35*a*, the armature 36 is pivotal about the eccentric shaft 35*a*. The eccentric shaft 35*a* and the armature 36** constitute means for fixing the printing head at a predetermined position.

A U-shaped notch **36*b* is formed at an end of one of bent portions of the armature 36. A stopper 35*b* extending from the carriage frame 35 is fitted in the U-shaped notch 36*b***.

The right and left carriage frames 35 are guided by the guide shafts 11 and 12 so as to move parallel to the platen 1.

The mode of operation of the printing mechanism with the above arrangement will be described below.

In the normal printing mode, the magnetic flux of the magnet 34 is led to the armature 36 through the yokes **34*a* and 34*b* so as to attract the armature 36 thereto. The printing head including the printing type wheel 2 is located at a predetermined position. The normal printing operation with the hammer 9 is performed. When the eccentric shaft 35*a* is rotated by the lever 35*e*, the contact position of the hole 36*a* and the eccentric shaft 35*a* is changed in accordance with the rotation of the eccentric shaft 35*a*, and the armature 36 is pushed. As a result, the motor 3 is moved along the elongate holes 35*c* and 35*d* through the yokes 34*a* and 34*b* which attract the armature 36. As shown in FIG. 8, the position of the printing type wheel 2 with respect to the platen 1** is changed.

Thus, when the eccentric shaft **35*a* is rotated, the printing type wheel 2 can be moved closer to or farther away from the platen 1**.

The stopper **35*b* is engaged with the U-shaped notch 36*b* with a slight play. Thus, the armature can be in tight contact with the yokes 34*a* and 34*b***.

As is apparent from the above description, according to the embodiments of the present invention, the distance between the printing type wheel and the platen can be adjusted within a predetermined range. Therefore, this distance may be arbitrarily determined in accordance with the thickness of the printing paper sheet and the number of copies to be produced according to the printing mechanism of the present invention.

The present invention is not be limited to the particular embodiments described above. For example, a ball-type printing type wheel or drum-type printing type wheel or the like may be used in place of the daisy-type printing type wheel.

The armature as means for positioning the printing head at the predetermined position is mounted to the carriage frame in the above embodiments. However, when the armature is mounted to the printing head, the magnet may be used as the means for positioning the printing head at the predetermined position. Further, an electromagnet may be used in place of the magnet. Magnets of opposite poles may be used for the armature and the magnet.

We claim:

1. A printing mechanism comprising:

a carriage movable in a printing line direction along a recording material;

a support mounting a type selection motor and a type wheel for printing on said carriage, said support being movable with respect to said carriage, rotatably about a rotation axis and linearly, between a printing position facing the recording material and an exchange position wherein the type wheel can be exchanged; and compulsory guide means for diverting a substantially unidirectional force exerted onto said support to a rotational movement of said support about the rotation axis, said rotational movement generated after substantial linear movement of said support in one direction, said linear and rotational movements being in a direction so that the support departs from the print position.

2. A printing mechanism according to claim 1, wherein:

said linear compulsory guide means includes a pair of congruent L-shaped slots in opposite, spaced-apart side walls of said carriage, each said L-shaped slot having an open end adapted to receive guiding pins on said support when said support is moved from the exchange position to the printing position, and a pair of congruent, arcuate guide slots for guiding a shaft on said support, the shaft being movable by means of a lever connected to said support for effectuating bodily movement of said support; and said support includes arcuate curve sections for engaging pins at the inner surfaces of the opposite side walls of said carriage, when said support is moved from the recording material the certain distance, to cause rotation of said support when the shaft is further moved.

3. A printing mechanism according to claim 2, wherein the lever is rotatable about a support shaft on said carriage.

4. An impact printing device according to claim 1, wherein said type selection motor, includes an output shaft being arranged for supporting said printing type wheel.

5. An impact printing device according to claim 1, further comprising support fixing means which includes position adjusting means for positioning said support.

6. An impact printing device according to claim 1, further comprising a pivot bearing arrangement which includes a slotted groove on said carriage for guiding a shaft mounted on said printing support and a pin mounted on said carriage for cooperation with a cam on said printing support.

7. An impact printing device according to claim 1, further comprising a locating pin and a locating cam for locating said printing support at an exchanging position remote from the printing position to facilitate the exchange of a printing type member.

8. A printing mechanism according to claim 1, wherein the substantial linear movement direction and the rotational direction of said support are perpendicular to said printing line direction.

9. A printing mechanism comprising:

a carriage movable in a printing line direction along a recording material;

a support mounting a type selection motor and a type wheel for printing on said carriage, said support being movable with respect to said carriage, rotatably, about a rotation axis and linearly, between a printing position facing the recording material and an exchange position wherein the type wheel can be exchanged; and linear compulsory guide means for permitting rotation of said support about the rotation axis after substantial linear movement of said support has started, said linear compulsory guide means including a pair of congruent L-shaped slots in opposite, spaced-apart side walls of said carriage, each said L-shaped slot having an open end adapted to receive guiding pins on said support when said support is moved from the exchange position to the printing position, and a pair of congruent, arcuate guide slots for guiding a shaft on said support, the shaft being movable by means of a lever connected to said support for effectuating bodily movement of said support;

said support including arcuate curve sections for engaging pins at the inner surfaces of the opposite side walls of said carriage, when said support is moved from the recording material the certain distance, to cause rotation of said support when the shaft is further moved, and the lever being rotatable about a support shaft on said carriage.

10. A printing mechanism according to claim 9, wherein the substantial linear movement direction and rotational direction of said support are perpendicular to said printing line direction.

* * * * *

UNITED STATES PATENT AND TRADEMARK OFFICE

CERTIFICATE OF CORRECTION

PATENT NO. : 4,865,476

DATED : September 12, 1989

INVENTOR(S) : Kondo et al.

It is certified that error appears in the above-identified patent and that said Letters Patent is hereby corrected as shown below:

OTHER PUBLICATIONS

Line 1, change "Automatic" to --Automated--.

COLUMN 1,

Line 40, change "portion 2bThe" to --portion 2b. The--.

COLUMN 4,

Line 44, change "control level 15" to --control lever 15--; and

Line 57, change "line" to --lines--.

COLUMN 5,

Line 1, change "plane" to --platen--; and

Line 49, change "the hole" to --a hole--.

COLUMN 6,

Line 27, change "or drum-type" to --or a drum-type--.

COLUMN 7,

Line 13, change "motor," to --motor--;

Signed and Sealed this

Thirtieth Day of July, 1991

*Attest:*

HARRY F. MANBECK, JR.

*Attesting Officer*

*Commissioner of Patents and Trademarks*